US005567897A

United States Patent [19]

McEwen

[11] Patent Number: 5,567,897

[45] Date of Patent: Oct. 22, 1996

[54] GUITAR PULL STRING DEVICE

[76] Inventor: Paul A. McEwen, 111 Belle Glen Dr., Nashville, Tenn. 37221

[21] Appl. No.: 587,415

[22] Filed: Jan. 16, 1996

[51] Int. Cl.[6] ..... G10D 3/14

[52] U.S. Cl. ..... 84/312 R; 84/297 R; 84/313

[58] Field of Search ..... 84/297 R, 312 R, 84/313

[56] References Cited

U.S. PATENT DOCUMENTS

| | | | |
|---|---|---|---|
| 3,479,917 | 11/1969 | Zitnik et al. | 84/312 |
| 3,512,443 | 5/1970 | Parson et al. | 84/313 |
| 3,686,993 | 8/1972 | Fender | 84/312 R |
| 3,990,431 | 11/1976 | Pace, Sr. | 84/313 |
| 4,354,417 | 10/1982 | Glaser, II | 84/312 R |
| 4,397,212 | 8/1983 | Carson | 84/313 |
| 4,535,670 | 8/1985 | Borisoff | 84/312 |
| 5,140,884 | 8/1992 | Bowden | 84/312 R |

*Primary Examiner*—Patrick J. Stanzione
*Attorney, Agent, or Firm*—I. C. Waddey, Jr.; Waddey & Patterson

[57] ABSTRACT

A string tension adjustment device for electric guitars, and particularly for use in conjunction with guitars having a bolt-on neck. The string tension adjustment device includes a body which holds the mechanism for applying the additional tension to a guitar string and the body is attached to a traditional guitar with bolt-on neck by removing the bolts that connect the neck to the body of the guitar, placing the body of the string tension adjustment device so that holes passing through it are in registry with the holes that receive the bolts for attaching the neck of the guitar to the body of the guitar and reassembling the entire mechanism by the bolts passing through the existing holes so that there is no necessity of impairing the integrity of the instrument. The string tension adjustment device itself includes an actuator which is pivotally mounted and includes a pull arm to which a shoulder strap is attached so that when the guitarist desires to activate the string tension adjustment device, he simply presses down on the neck of the guitar to pull the pull arm which in turn pulls a linkage mechanism that pulls or "bends" the desired string of the guitar.

3 Claims, 5 Drawing Sheets

GUITAR PULL STRING DEVICE

BACKGROUND OF THE INVENTION

The present invention relates generally to a string tension adjustment attachment for guitars and similar instruments and more particularly to a string tension adjustment attachment that can be installed on any guitar or other stringed instrument that has a bolt-on neck without invading or impairing the integrity of the instrument.

It will be appreciated by those skilled in the art that string tension adjustment attachments for guitars and other stringed instruments are well known and have been in use for many years. To Applicant's knowledge, the first such device was invented by Parsons, et al. and patented in U.S. Pat. No. 3,512,443. The Parsons, et al. '443 string tension adjustment device was an immediate commercial success and many improvements followed. One of the first improvements was developed by Clarence Fender, maker of the extremely popular Fender electric guitar series and patented in U.S. Pat. No. 3,686,993. Subsequent improvements include the device described in the patent to Joseph Glaser issued in Sep. 16, 1981, U.S. Pat. No. 4,354,417; U.S. Pat. No. 4,397,212 to Carson; U.S. Pat. No. 4,535,670 to Borisoff; and U.S. Pat. No. 5,140,884 to Bowden.

By way of background, and to describe the type devices that have been improved by Applicant's invention, the disclosures of the above identified patents are incorporated herein by reference.

For purposes of convenience, in this description of Applicant's invention, the stringed instrument to which the improvement that Applicant has developed is to be attached will be referred to as a guitar. Those skilled in the art will recognize that the device can be applied to any stringed instrument which has a bolt-on neck.

A primary flaw with most of the prior art string tension adjustment devices is that installation of the device requires some modification of the instrument to which it is attached. The prior art devices, as indicated, generally impair the integrity of the existing instrument. For example, the Parsons device requires a fitting to pass through the body of the guitar, an extra body part mounted on the rear of the instrument and various screws screwed into the back side of the guitar to hold the mechanism in place. To the purest, mounting an attachment similar to the Parsons device on a Fender Stratocaster or a Telecaster guitar would be blasphemous, requiring a disfigurement of the back side of the body of the guitar and making a vintage instrument worthless. Similarly, the device described in the Fender patent itself destroys the integrity of the instrument by routing a cavity in the back side of the guitar to contain the leverage system that operates the string tension adjustment device of that particular invention.

The Glaser patent likewise discloses a routed channel in the back side of the guitar in order to accommodate the string tension adjustment device improvement that he developed. Routing out the back of the instrument will also drastically change the sound of the instrument.

The Carson device, while not necessarily disfiguring the instrument itself, gives the instrument the appearance of a guitar mounted in a body cast. While the device may be functional, it certainly is aesthetically displeasing and is unlikely to achieve significant commercial success.

Two string tension adjustment devices that are illustrated by the prior art which can be mounted on the guitar without damaging the guitar are the device developed by Borisoff, referred to as the "hip shot" and disclosed in the '670 patent referred to above, and the string tension adjustment device developed by Bowden and assigned to Gibson Guitar Corporation as is disclosed in the '884 patent referred to above. While the latter two devices can be mounted to a guitar without impairing its integrity, the Borisoff device is operated by pressing the lever against the hip of the artist and the Bowden device is operated by the heel of the hand of the guitar player. Both of these devices lack the convenience of operation that the strap pulled mechanism as originally developed by Parsons offers. Further, both of these devices rely on the string tension to return to pitch, a flaw that is exaggerated as strings get thinner.

What is missing in the prior art, then, is a device that can function as a string tension adjustment device for a guitar and can be attached by the user to a quality instrument without impairing the integrity of the instrument and yet can be operated by the pull of a shoulder strap of the player of the instrument. Such a device is presently lacking in the prior art and it is the objective of the present invention to fill this void.

SUMMARY OF THE INVENTION

My invention is a string tension adjustment device for electric guitars, and particularly for use in conjunction with guitars having a bolt-on neck. The string tension adjustment device includes a body which holds the mechanism for applying the additional tension to a guitar string and the body is attached to a traditional guitar with bolt-on neck by removing the bolts that connect the neck to the body of the guitar, placing the body of the string tension adjustment device so that holes passing through it are in registry with the holes that receive the bolts for attaching the neck of the guitar to the body of the guitar and reassembling the entire mechanism by the bolts passing through the existing holes so that there is no necessity of impairing the integrity of the instrument. The string tension adjustment device itself includes an actuator which is pivotally mounted and includes a pull arm to which a shoulder strap is attached so that when the guitarist desires to activate the string tension adjustment device, he simply presses down on the neck of the guitar to pull the pull arm which in turn pulls a linkage mechanism that pulls or "bends" the desired string of the guitar.

DESCRIPTION OF THE PREFERRED EMBODIMENT

Applicant's invention will be best understood by a review of the detailed description of the preferred embodiment of the invention in conjunction with FIGS. 1–5 of the drawings appended hereto wherein like numerals refer to like parts throughout.

Figure 1:
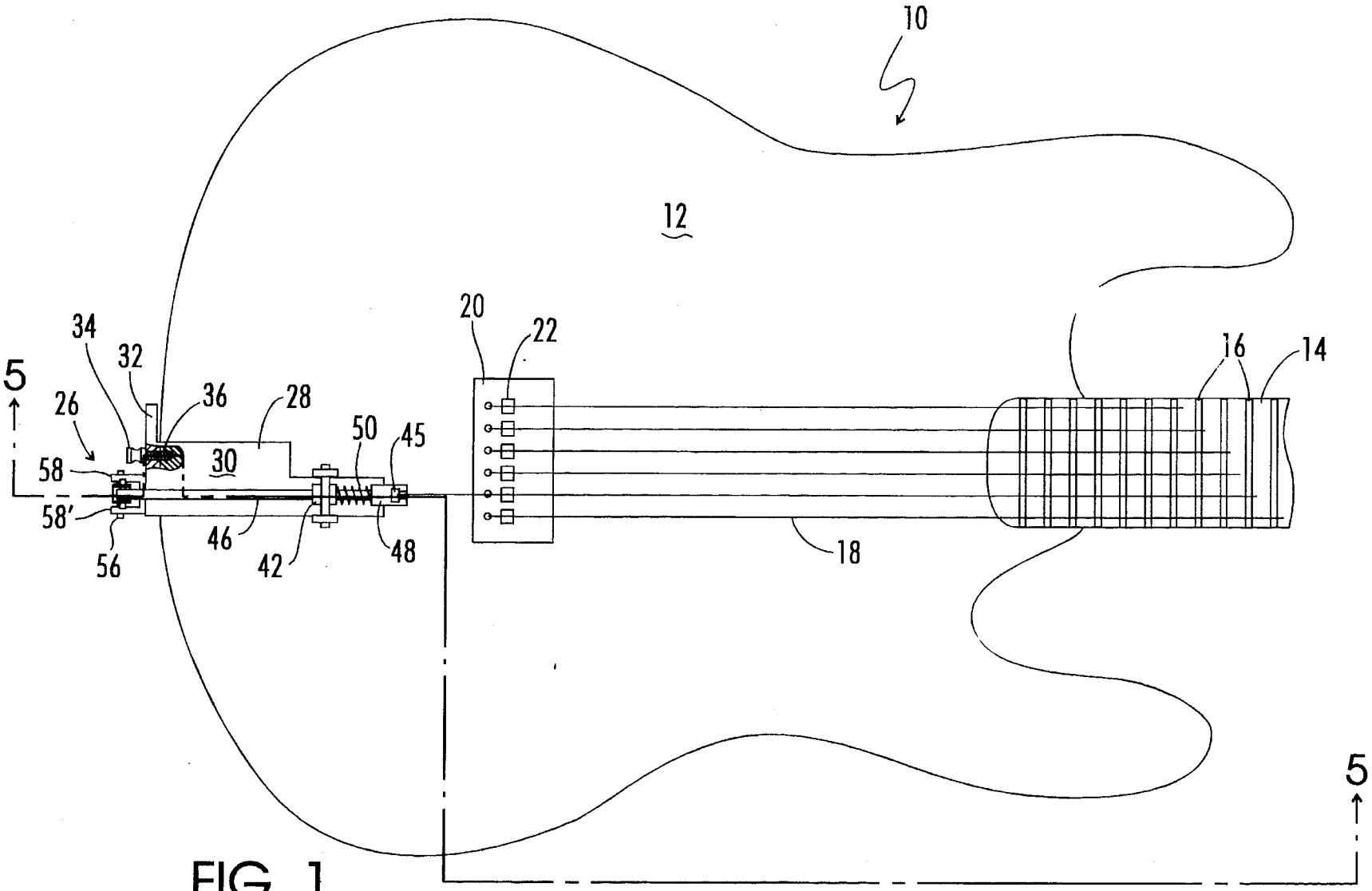
FIG. 1 is a front view of a typical electric guitar with a bolt-on neck with the device of the present invention attached thereto.
Figure 2:
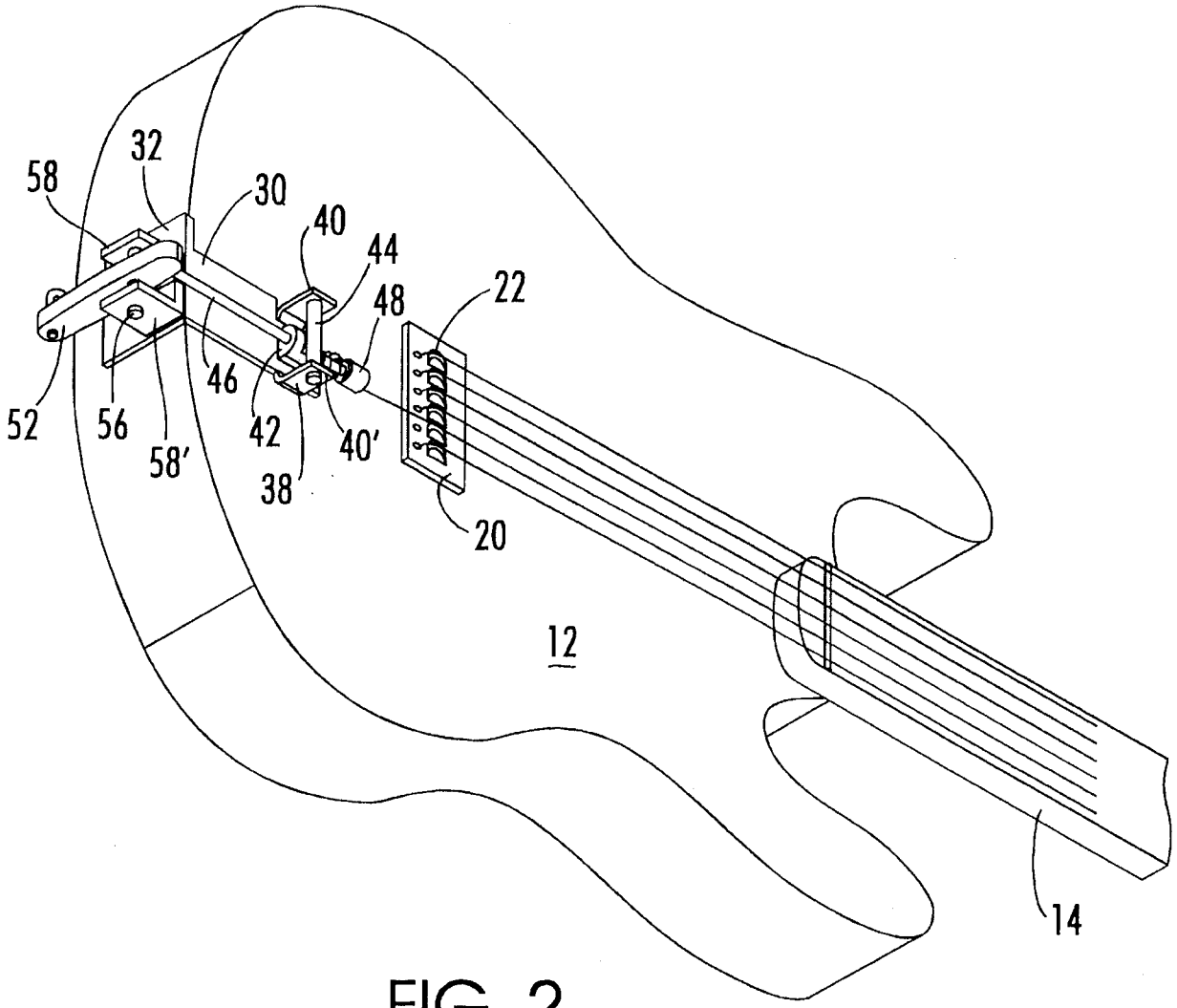
FIG. 2 is a partial perspective from the front of the guitar shown in FIG. 1.
Figure 5:
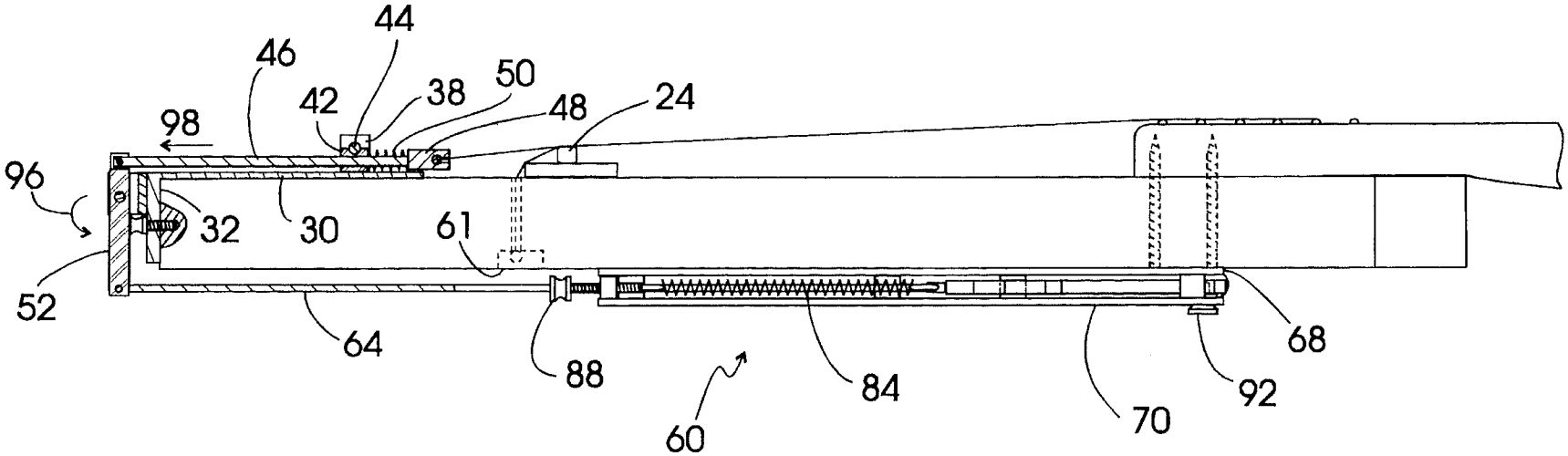
FIG. 5 is a bottom view, in partial cross section, taken along line 5—5 of FIG. 1, showing the invention mounted on a guitar.

Referring now to FIGS. 1, 2 and 5, an electric guitar 10 is illustrated having a body 12 and a bolt-on neck 14. The neck has frets 16 and strings 18 all assembled in a well known manner.

The bridge 20 includes posts 22 protruding perpendicularly out from the face of the guitar. The invention is illustrated in conjunction with a six-string guitar with the string tension adjustment device of the present invention attached to the B-string, the string with which a tension adjustment mechanism is most commonly used. The posts 22 each have an notch 24 in the face thereof (see FIG. 5) and each of the strings is threaded through a hole in the body of the instrument over the notch, then passing over the face of the instrument, up the neck and attached to pegs at the headstock of the instrument. A stop mechanism will be provided at one end of the string so as to hold the string against a plate in the back of the instrument. Thus, the instrument can be tuned by tightening the string over pegs carried by the headstock of the guitar (not shown).

The string tension adjustment device of the present invention is made in two parts. The first part is the bout-mount mechanism 26 mounted on the bout or rear of the guitar. The mechanism 26 includes a plate 28 including a face 30 and a heel 32. The face and heel are aligned substantially perpendicularly to each other so as to fit over and mate with the bout of the guitar. A felt of other soft material liner can be glued to the back side of the face 30 and the heel 32 to prevent scratching of the instrument when the device is mounted onto it. The mechanism 26 is mounted to the bout of the guitar by removing the standard strap post 34 (usually a screw-in post) and placing the mechanism over the bout of the guitar with a hole formed in the heel 32 aligning with the hole in the bout of the guitar so that the strap post 34 can be reinserted into the hole in the bout of the guitar and securely attached thereto by the screw 36 that protrudes from the strap post 34. Thus, the mechanism 28 can be mounted on the bout of the guitar without the necessity for adding any holes to the guitar or making any other changes to the guitar in its shape or configuration.

The mechanism 26 has a yoke 38 protruding perpendicularly from the face 30. The yoke 38 includes legs 40, 40' and a sleeve 42 is mounted between the legs 40, 40' of the yoke 38. The sleeve 42 has a hole passing through it (see FIG. 5) and the axis of the hole passing through the sleeve 42 is in substantial registry with the length of the B-string of the guitar.

A brace 44 extends between the legs 40, 40' and overlies the sleeve 42 to hold the sleeve 42 in place. Rod 46 passes through the hole in the sleeve 42 and is slidably journaled therein. A block 48 is included on the end of the rod 46 adjacent the bridge 20 and the block 48 has an eyelet 49 for receiving the stop structure on the end of the B-string so that the B-string can be connected to the end of the rod 46 by inserting the stop on the end of the string in the eyelet 49 and then the string is threaded through the hole in post 22.

A spring 50 is located between the shoulder of the block 48 and the shoulder of the sleeve 42 and is coiled about the rod 46 in order to force the B-string toward the bridge 20 when the system is in an "at rest" position, that is when the string tension adjustment device of the present invention is not activated. The string is fixed against the pressure of the spring 50 because the end of the rod 46 opposite the block 48 is attached to a lever 52 and the lever 52 is limited in the movement that it can make in the direction of the bridge 20. The lever 52 is pivotally mounted at 54 via a pin 56 extending between legs 58, 58' protruding from the heel 32 of the mechanism 28. FIG. 5 also illustrates the attachment arrangement between the end of the rod 46 and the lever 52. FIG. 5 clearly illustrates that the lever 52 can pivot about pivot point 54 only in a limited manner before its movement is arrested by the stop adjacent the strap lever as described hereinafter, holding the device in the "at rest" position.

Figure 3:
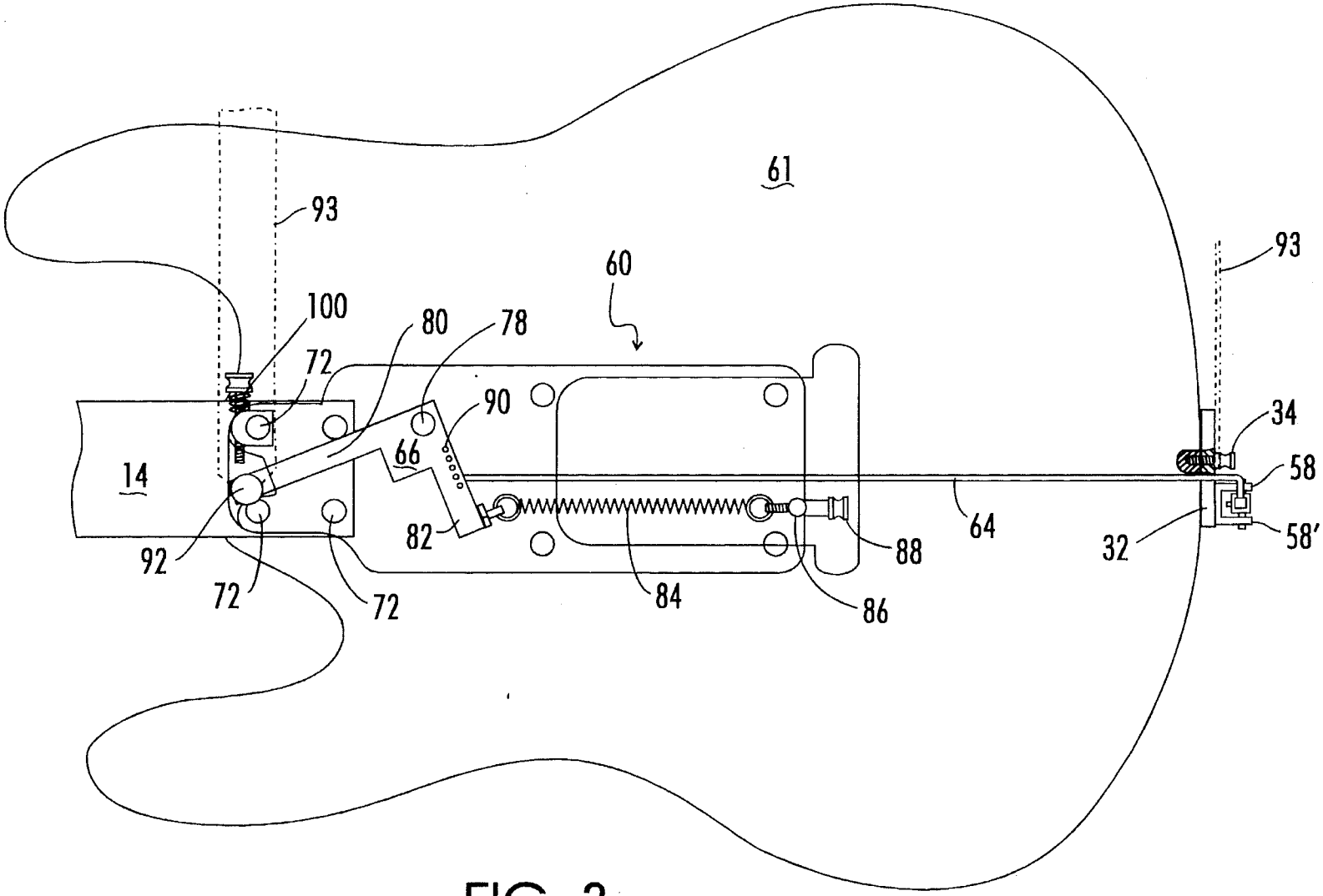
FIG. 3 is a back view of the guitar of FIG. 1 with the mechanism attached to the back side of the guitar.
Figure 4:
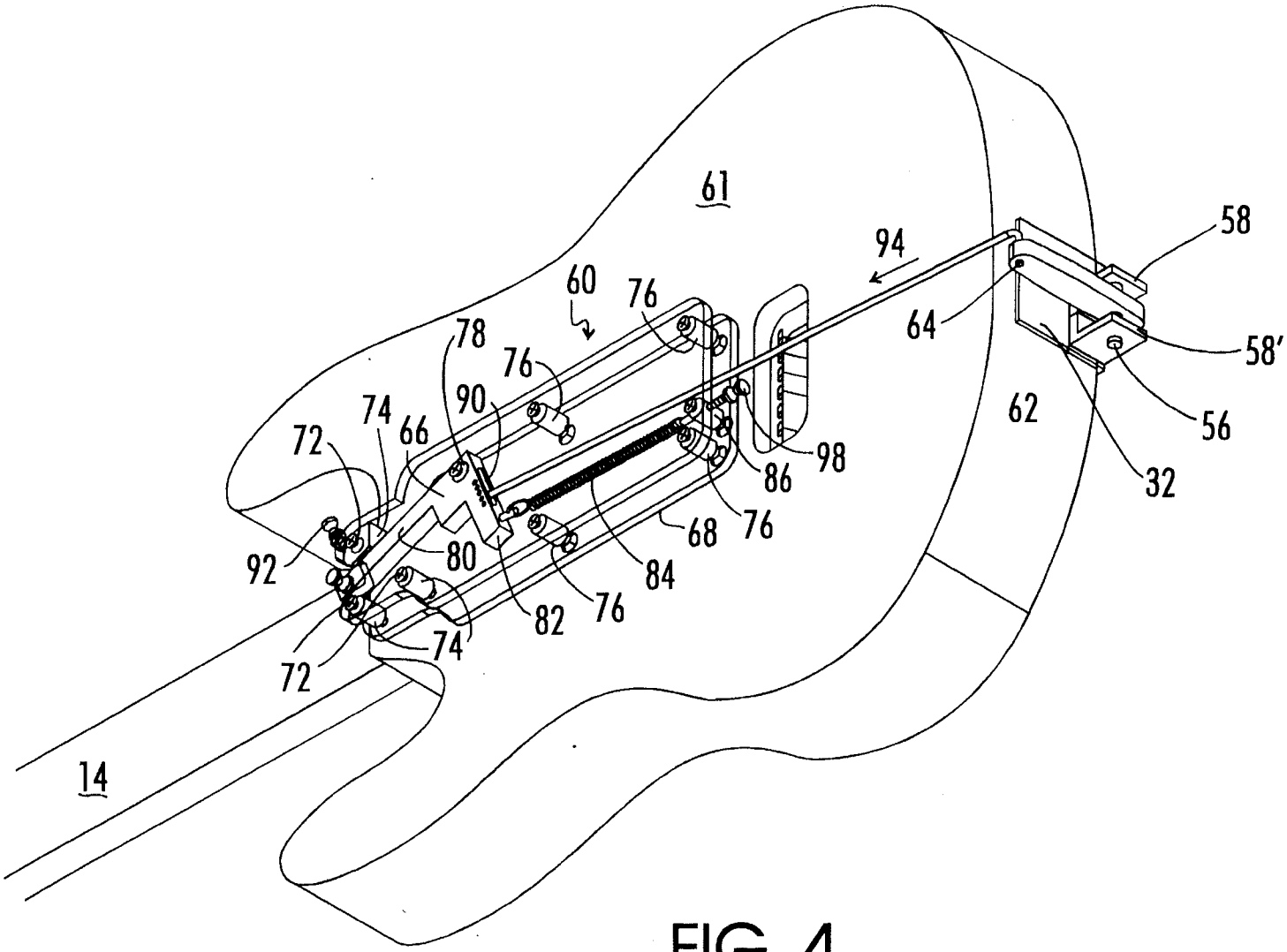
FIG. 4 is a partial perspective view of the back of the guitar of FIG. 1.

Looking now at FIGS. 3, 4 and 5, the back mounted mechanism 60 is shown mounted on the back 61 of the guitar 10. The back mounted mechanism 60 is connected via rod 64 to the end 62 of the lever 52 to activate the pivot motion of the lever 52 about the pin 56 in order to bend the string of the guitar when the mechanism is actuated. The rod 64 is connected to an actuator 66 which is sandwiched between a bottom plate 68 and a top plate 70 of the back mounted mechanism 60. The bottom plate 68 and top plate 70 are mounted to the back of the guitar by screws 72 which are used to replace the screws that traditionally mount the neck of an electric guitar to the body of the guitar. The screws 72 are longer than the traditional screws because they must pass through the plates 68, 70 which plates are spaced apart in order to provide room to sandwich the mechanism of the system between them. Spacers 74 are provided which serve as sleeves for the screws 72 and to space the top plate 70 from the bottom plate 68. Auxiliary spacers 76 are provided around the perimeter of the two plates 68, 70 to maintain those plates in spaced relationship. The spacers 74 are connected to the plate 68 and 70, but they do not extend through the bottom plate 68 nor are the spacers or the plates attached to the body of the guitar at any point other than through the replacement screws 72 at the neck of the guitar. By providing the plates 68, 70, the surface of the back of the guitar is protected from being scratched or otherwise marred through operation of the string tension adjustment mechanism (preferably with felt mounted on the bottom plate) and the top plate 70 allows the player of the guitar to rest the guitar on his chest against the face of the top plate 70 but the internal working mechanism of the actuator will not be interfered with. Thus, the back mounted mechanism 60 can be attached to a traditional electric guitar, which may be an instrument having value in and of itself and which value would be impaired if the instrument had to be modified in order to receive the string tension adjustment mechanism. There are no new holes or slots of any type made in the guitar in order to mount the back mounted mechanism 60 to it, thus, the integrity of the instrument is maintained.

Looking now at the internal working mechanisms of the actuator of the string tension adjustment device, from FIGS. 3, 4 and 5, one can see the pin 78 which extends between the top and bottom plates. The actuator 66 is mounted via the pin 78 and is able to rotate about the pin. The actuator 66 includes a pull arm 80 which is generally perpendicular to an actuator arm 82. A spring 84 is mounted to the end of the actuator arm 82 and extends to a post 86 and is attached to the post 86 by an adjustment screw 88. Thus, the spring 84 will tend to pull the actuator mechanism 66 for rotation in a counter-clockwise direction (when the mechanism is considered from the views illustrated in FIGS. 3 and 4) so as to hold the actuator mechanism in an at rest position until actuated. The strength of the pull of the spring 84 can be adjusted by adjusting the screw 88 so as to tighten the spring or loosen it as the need arises.

The rod 64 is connected to the actuator arm 82 at any one of a series of holes 90 along the perimeter of the actuator arm 82. Thus, the device is adjustable (for the length of the strap pull) depending upon the particular guitar to which it is attached. The rod 64 can be placed in the top hole 90 on a shorter body guitar and in the bottom hole on a longer body guitar.

The pull arm 80 has a strap post 92 on the end thereof, and FIG. 3 shows a strap 93 attached to the strap post 34 at the bout of the guitar and about the strap post 92 on the end of the pull arm 80. The strap 93 will be fitted over the shoulder of someone playing the guitar and the mechanism can be actuated by pulling down on the neck 14 of the guitar against the pressure of the strap 93 so that the pull on the strap 93 will cause an upward pull on the post 92 on the end of pull arm 80, causing the mechanism 66 to rotate in a clockwise direction, thereby causing rod 64 to be pulled and moved in the direction of arrow 94. Pulling rod 64 in the direction of arrow 94 causes the lever arm 52 to be rotated in the direction illustrated by arrow 96 in FIG. 5, thus causing rod 46 to be pulled in the direction of arrow 98 and thereby increasing the tension on the string attached via the eyelet to the block 48 of the mechanism. When the neck of the guitar is raised, the pull against the strap 93 is released and the spring 84 will pull the mechanism 60 (and the guitar neck) back to the at rest position to relieve the pull on the string attached to the mechanism.

The pull arm 80 is positioned so that spacer 74 serves as a stop on counter-clockwise rotation of the mechanism 66. Likewise, the extent of the pull or bend on the string can be limited by the adjustment screw 100 which passes through the uppermost spacer 74 and can be screwed to move up or down (as illustrated in FIG. 3) and thereby adjust the length of stroke of movement of the pull arm 80 as it rotates in the clockwise direction about the pin 78 upon actuation of the device.

As has been indicated, string tension adjustment devices are well known in the art. The problem with the string tension adjustment devices of the prior art is that they generally can only be mounted by major modification of the instrument. Applicant's invention provides a string tension adjustment device that can be added to a guitar without any modification of the instrument itself simply by removing the screws that connect the strap post at the bout of the guitar and the neck of the guitar to the body of the guitar, mounting the tension adjustment device through those existing holes and reattaching the strap post to the bout of the guitar and the neck to the body of the guitar with the system in place.

Although there have been described particular embodiments of the present invention of a new and useful guitar string tension adjustment device, it is not intended that such references be construed as limitations upon the scope of this invention except as set forth in the following claims.

What I claim is:

1. A string tension adjustment mechanism for a stringed musical instrument having a body with opposing ends, a bout at one end of said body and a neck attached to the other end of said body by screws and strings extending from a point adjacent said bout over said body to said neck, said mechanism including means attached to a string of the instrument for holding said string at one level of tension when said string tension adjustment mechanism is in an at rest mode and for applying additional tension to said string when said string tension adjustment mechanism is activated, means for moving said string holding means between said at rest position and said activated position, said instrument having a strap post screwed into the bout of the instrument, a shoulder strap connected to said instrument, said moving means being actuated by a force applied to said shoulder strap, said string tension adjustment mechanism including a bout mounted mechanism and a back mounted mechanism, said bout mounted mechanism attached to the bout of the instrument by the screw holding the strap post to the instrument and the back mounted mechanism being attached to the instrument by the screws mounting the neck of the instrument to the body of the instrument.

2. The string tension adjustment mechanism for a stringer musical instrument of claim 1 wherein said bout mounted mechanism includes a plate having a face and a heel, the face and the heel of said plate being connected substantially perpendicularly to each other and shaped to mate with and fit over the bout of said instrument, a hole in the heel of said instrument through which the strap post passes, a lever mounted on said heel for pivotal movement, a rod connected to one end of said lever and the string to which tension is to be applied being attached to said rod, a second rod attached to an opposite end of said lever, said second rod being attached to an actuator, said actuator having a strap post to which said shoulder strap is connected.

3. The string tension adjustment mechanism for a string musical instrument of claim 1 further including a pair of plates with said back mounted mechanism sandwiched between said plates.

* * * * *